United States Patent [19]

Koshman et al.

[11] 4,368,443

[45] Jan. 11, 1983

[54] POWER ELECTRIC CIRCUIT SWITCHING DEVICE

[76] Inventors: Vitaly I. Koshman, bulvar Shevchenko, 123, kv. 25; Vladimir F. Petrichenko, ulitsa Prozhektornaya, 6, kv. 44; Boris S. Gnilitsky, ulitsa Artema, 116, kv. 21; Vyacheslav D. Oborotov, ulitsa Marii Ulyanovoi, 65, kv. 53; Alexandr M. Ubiiko, bulvar Shevchenko, 115, kv. 30; Leonid P. Abara, ulitsa Nizhnekurganskaya, 3, kv. 192, all of Donetsk, U.S.S.R.

[21] Appl. No.: 249,840

[22] Filed: Apr. 1, 1981

[51] Int. Cl.[3] ..... H01H 51/08

[52] U.S. Cl. ..... 335/138; 335/72; 335/118

[58] Field of Search ..... 335/72, 77, 121, 118, 335/139

[56] References Cited

U.S. PATENT DOCUMENTS 4,281,304 7/1981 Koshman et al. ..... 335/72

FOREIGN PATENT DOCUMENTS 320846 7/1982 U.S.S.R. .

*Primary Examiner*—William M. Shoop

*Attorney, Agent, or Firm*—Fleit & Jacobson

[57] ABSTRACT

On an insulating baseboard with a central opening there are located contacts. There are also auxiliary contacts intended for connecting local control circuits of the device. A rotational electromechanical drive is provided to rotate a contactor, and an electromagnetic drive is adapted to reciprocate said contactor for operating contacts. The electromagnet drive has an electromagnet for closing contacts and a plurality of electromagnets for opening contacts. The number of the electromagnets corresponds to the number of the contact fixing devices. The armature of each electromagnet is connected with one of the contact fixing devices.

7 Claims, 7 Drawing Figures

POWER ELECTRIC CIRCUIT SWITCHING DEVICE

BACKGROUND OF THE INVENTION

1. Field of the Invention

The present invention relates to a remote control of electric energy consumers, and more specifically is concerned with an apparatus for switching electric circuits.

The invention can be used in apparatus for exerting control over a plurality of electric energy consumers, for instance, group of electric motors in various industries, and in particular in coal mines.

2. Prior Art

There are known apparatus to exercise control over a group of electric motors (control station), which comprise a great number of contacts, intermediate relays and other switching elements, the number of which is determined by the number of remoutly controlled electric motors. These apparatus, however, are complex, bulky and feature a low service reliability.

Special problems are encountered in designing apparatus for controlling machines operating in mines in an explosive atmosphere. In this case in order to provide for safety operation a number of special requirements must be met, such as, for example, check of insulation of an electric circuit connecting the machine with an electric energy source.

To meet these requirements each set of apparatus designed for controlling an individual electric energy consumer is provided with a special control device.

USSR Author's Certificate No. 320,846 discloses an apparatus for switching high voltage equipment, which comprises a stationary contact panel having contacts located in a circle, an electromagnetic drive having an actuator mounted for rotation about and reciprocating motion along an axis passing through the centre of said circle and perpendicular to the plane of the contacts. The apparatus further includes a switching unit rigidly connected to the actuator of the electromagnetic drive and adapted to close and open contacts when the electromagnetic drive operates. Mounted on the electromagnet armature, which serves an an actuator, is a master cam constructed in the form of a coupling and having on its cylindrical surface a saw-like slot with a varying depth, intended for a pin to move therein, which pin is secured on the electromagnet frame.

When a voltage pulse is applied to the electromagnet coil the armature is pulled in response to which the pin moves along the surface of the saw-like slot to interact therewith and to thereby rotate the armature together with the switching element through an angle which is determined by a tooth spacing of the saw-like slot.

The above apparatus permits electric circuits to be switched only in succession and therefore does not allow selectively switching on individual electric energy consumers.

Furthermore, this apparatus also does not allow several or all the electric energy consumers under control to be energized simultaneously.

In addition, the apparatus in question is not provided with a means to protect the electric circuits under control in the case of voltage collapse in the supply circuit of the electric energy source.

Using this apparatus requires auxiliary switching elements.

For the above reasons the prior art apparatus when used to control a group of electric energy consumers does not allow the number of relays and supplementary switching elements to be appreciably reduced.

There is also known an electric circuit switching device (cf. USSR Application No. 2,195,531/07, 134,081, filed Dec. 1, 1975, U.S. Application No. 15,167, filed Feb. 26, 1979, FRG Application No. P.2904287 filed Feb. 5, 1979, Romanian Application Ser. No. 17,086/96,538 filed Feb. 7, 1979, French Application Ser. No. 7,903,871 filed Feb. 15, 1979, British Application Ser. No. 7,904,820 filed Feb. 12, 1979, Indian Application Ser. No. 103/Cal/79 filed Jan. 31, 1979/which comprises main contacts composed of stationary contact members located in circle on an insulating panel, and a movable contact members, auxiliary contacts for switching local control circuits of the apparatus, means for selectively operating contacts, provided with contact position fixing devices. The device further includes a contactor having at least one projection to actuate the contact closing means, a rotational electromechanical drive having a shaft passing through the central aperture in said insulating panel and being adapted to rotate the contactor through a predetermined angle. The device also includes an electromagnetic drive incorporating an electromagnet for closing contacts, which electromagnet is provided with a hollow armature enveloping the shaft of the electromechanical drive, with the said contactor being mounted on the said hollow armature. The said electromagnet is also adapted to move the said contactor along the shaft of the electromechanical drive while closing contacts. The electromagnetic drive is also provided with electromagnets to open contacts, one of which electromagnets is constructed similar to the electromagnet for making contacts and is adapted to actuate the contact breaker, while the other one operates in the case of voltage collapse in the supply circuit of the electric energy consumer to break all the contacts and to thereby provide a zero-voltage protection.

The above device makes it possible with the aid of only one common drive for making contacts in the circuit under control to selectively connect a group of power supply electric circuits so as to allow several or all the circuits of said group to be energized simultaneously. Such construction of the above device permits the number of elements required for switching said group of circuits to be appreciably reduced. Thus, for instance, the number of electromagnets involved is reduced by half. In addition, the presence of the unit adapted for setting an angle of rotation of a contact maker and contact breaker and provided with additional contacts allows checking insulation of all the circuits under control before making them with the use of only one relay.

However, when incorporated in the systems operating in explosion-hazardous places, the advantages of this device cannot be utilized to the best.

Thus, for instance, the presence of separate disconnecting electromagnet and electromagnet for zero-voltage protection complicates the construction of the device and the manufacture thereof. Furthermore, it does not provide for a rapid selective disconnection of the circuits under control, since such operation takes a certain time for finding the required contact corresponding to a circuit to be disconnected.

A still further advantage of the above device is that it is not protected against collapse of control which may happen as a result of, for example, failure of the electromagnet for breaking contacts, which results in that the circuits under control cannot be selectively disconnected.

SUMMARY OF THE INVENTION

The main object of the invention is to provide a device for switching power circuits, which due to the improved construction of an electromagnetic drive enables a more rapid selective disconnection of the circuit under control.

Another object of the invention is to simplify the construction of the device and the manufacture thereof.

Still another object of the invention is to provide an apparatus for switching power circuits, which takes shorter time for finding a contact of the corresponding circuit.

A further object of the invention is to provide protection of said device against collapse of control.

These and other objects of the invention are attained in a device for switching power circuits comprising main contacts composed of stationary contact members located in a circle and movable contact members, auxiliary contacts for switching local control circuits of the device, mechanisms for separately closing contacts, provided with contact fixing devices, a contactor having at least one projection to actuate the means for operating contacts, a rotational electromechanical drive having a shaft adapted to rotate the contactor through a predetermined angle, an electromagnetic drive having an electromagnet for closing contacts on whose hollow armature embracing the shaft of the electromechanical drive is secured said contactor, which electromagnet is adapted for moving the contactor along said shaft and provided with electromagnets for opening contacts, and wherein according to the invention the armature of each electromagnet for opening contacts is connected with one of the contact fixing devices so as to enable opening the respective contacts.

Such construction of the device provides for a rapid emergency disconnection of any of the power circuit under control in the case of failure either in the control circuit or in the electromagnet for opening contacts, whereby providing for a protection against a control failure and improving operating characteristics of the device. In addition, the height of the device is decreased by 20%.

It is useful to construct the proposed apparatus so that some of the auxiliary contact pairs be connected with the electromagnets for breaking contacts so as to operate the latter when said electromagnets operate.

Such embodiment of the invention makes it possible to omit the intermediate relays since the electromagnets for breaking contacts, connected with the auxiliary contacts, are similar to these relays as regard their functions.

It is convenient that the electromagnets for breaking contacts be constructed as a zero-voltage release for actuating fixing devices when the coils of these electromagnets are deenergized.

It is expedient that some of the auxiliary contacts connected with the electromagnets for opening contacts be placed in the control circuit of the rotational electromechanical drive.

It is also advisable that the coils of the electromagnets for opening contacts have spark-resistant characteristics.

It is also expedient that the main and auxiliary contacts the mechanisms for separately closing contacts and the contact fixing devices be mounted on plug-in modules arranged on a common base plate so that each said module incorporates at least one main contact, at least one auxiliary contact, and the respective mechanism for separately closing contacts, and a contact fixing device for fixing the contacts in position.

Such construction of the apparatus facilitates the manufacture and operation thereof (replacing units, maintenance, adjusting). In addition, it allows manufacturing various modifications of the device for controlling different number of electric drives, and working on different rated currents, and provides for a high level of unification of all possible modifications.

In the case of controlling three-phase circuits it is useful that each said module incorporate three main contacts and a device for fixing position of contacts be connected, through the mechanism for separately closing contact pairs, with a cross arm connecting movable contact members of the main contacts.

Figure 1:
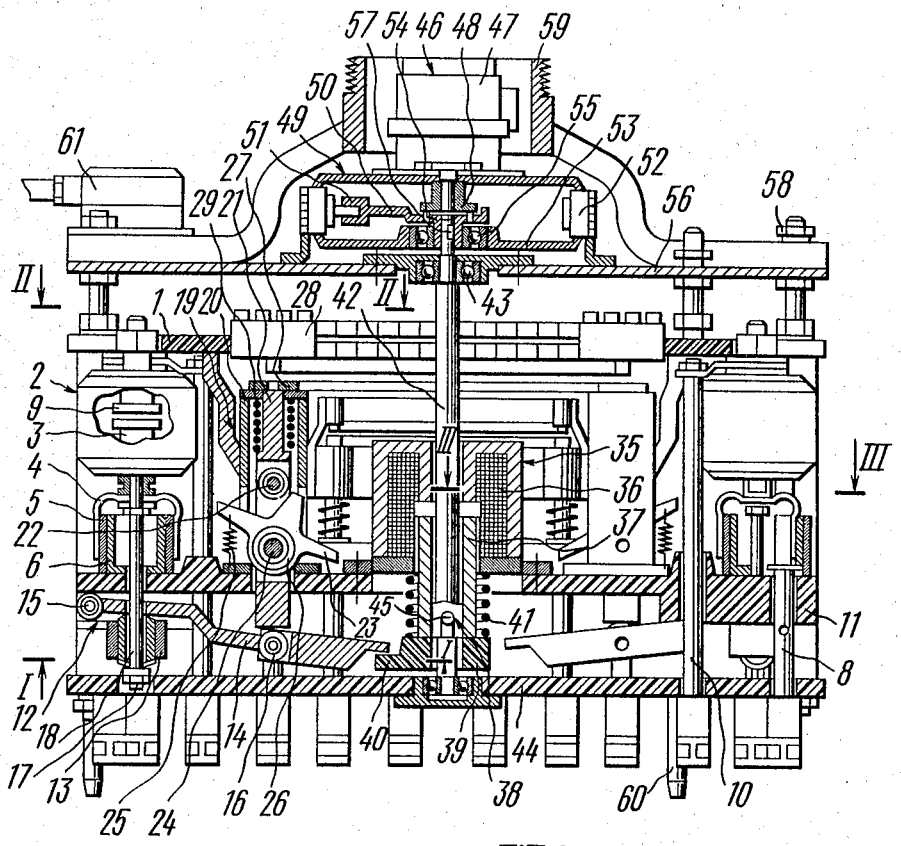
FIG. 1 shows a power circuit switching device of the invention in a de-energized position.
Figure 2:
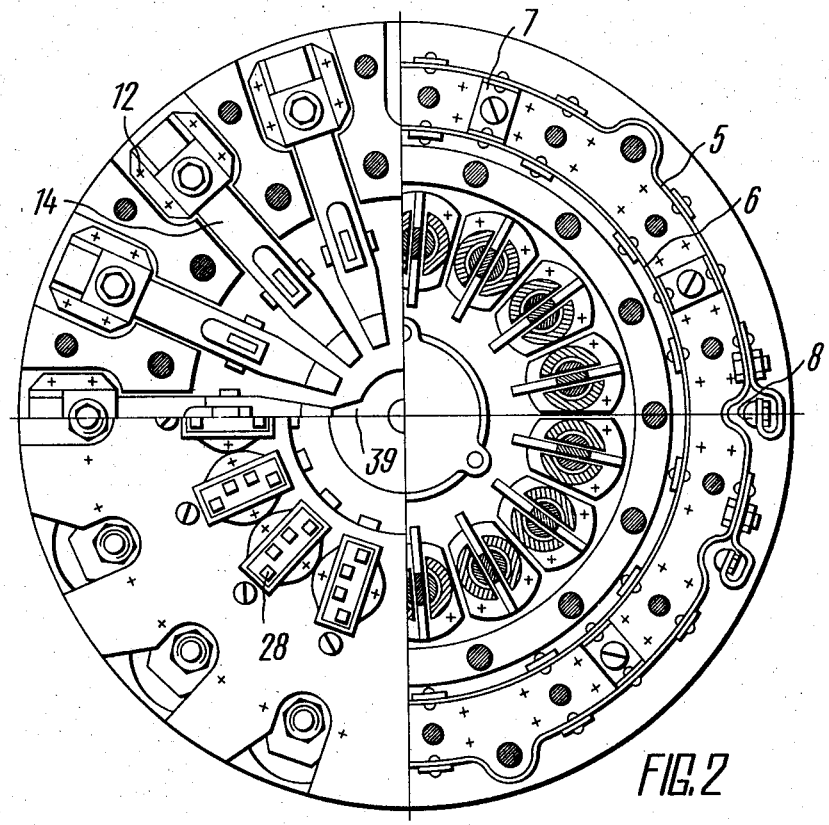
FIG. 2 is a top view of the proposed device shown in section along line A—A in FIG. 1.

In a preferred embodiment of the invention the proposed device for switching power electric circuits comprises four panels each made in the form of a disk. The upper insulating panel 1 (FIG. 1) has stationary contact members uniformly distributed in a circle thereon. In this modification as main contacts 2 use is made of vacuum arc-extinction chambers. The number of the contacts 2 is determined by the number of the circuits under control. This modification of the proposed device is adapted to exercise control over 15 single-phase power circuits. The movable contact members of the contacts are connected through flexible conductors 4 to bus bars 5 and 6 which are connected therebetween through jumpers 7 (FIG. 2).

The bus bars are connected with pin jacks 8 (FIG. 1) intended for connecting the device to a supply circuit. Terminals of the stationary contact members 9 of the contacts are also made in the form of pin jacks 10. The bus bars 5 and 6 are secured to an intermediate insulating panel 11 on the under side of which are mounted mechanisms 12 to operate contacts. The number of these mechanisms corresponds to the number of the contacts 2.

Each mechanism 12 comprises a frame 13 wherein is disposed a lever 14 mounted on an axle 15 and fitted with pressure rollers 16. The lever 14 is connected, through a bush 17 and a pin 18, with a movable contact member 3.

Mounted on the top side of the intermediate panel 11 are contact fixing device 19 adapted to fix said contacts in position. The lock 19 is a cylindrical body 20 having a spring-loaded rod 21 fitted with a roller 22, and a catch 23 mounted on an axle 24 in an opening of the frame 20 and provided with a return spring.

For the purpose of reducing friction the roller 22 may be replaced with a ball bearing. For the same purpose the catch 23 is also provided with a ball bearing 26. The rod 21 has a pressure plate 27 being mounted on the outside portion thereof and adapted to operate a microswitch 28 mounted on the upper insulating panel 1 and used as auxiliary contacts (first group of the auxiliary contacts). There is also provided a spring 29 of the contact fixing device 19, which spring 29 is adapted to actuate the rod 21 which applies a biasing force on lever 14 to open and close the movable contact members 3 of the contact 2. Each fixing device 19 is connected with an electromagnet 30 adapted for opening contacts (FIG. 3) by actuating the fixing device 19 by means of a rod 31 provided with a spring 32 and coupled with the armature of the electromagnet 30.

Each electromagnet 30 incorporates a microswitch 33 serving as auxiliary contacts (second group of the auxiliary contacts) and interacting with a rod 34. In FIG. 1 said electromagnet is shown in a deenergized position.

Figure 3:
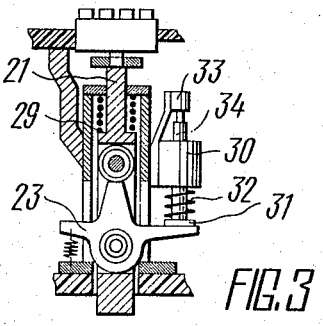
FIG. 3 is a fixing device for fixing position of contacts the contact is fixed in its closed position.

The working position of the elements of the contact fixing device 19 with the contacts in closed position is shown in FIG. 3.

In the above embodiment the electromagnets of the apparatus are constructed in the form of a zero-voltage release. They may also be otherwise constructed, for example in the form of an independent release (not shown).

On the insulating panel 11 there is mounted an electromagnet 35 of a solenoid type adapted for closing contacts. Due to the presence of the fixing device 19 the coil 36 of the electromagnet 35 is designed for a short-time operation and therefore has a small size. The armature of the electromagnet 35 is made in the form of a hollow cylinder having at its one butt-end a slot 38 and a contactor 39 rigidly mounted thereon.

The contactor 39 is provided with projections 40 to actuate the levers 14. The number of the projection depends on the number of circuits being simultaneously switched and on the type thereof (multiphse, single-phase, d.c. circuits). In the above embodiment of the device adapted for use in single-phase circuits the contactor 39 has one projection. The armature 37 is provided with a return spring 41. The driving shaft 42 is disposed in the openings provided in the contactor 39, and in the frame and armature of the electromagnet 35, and is mounted in ball bearings 43 provided in the upper insulating panel 1 and the lower panel 44. The driving shaft 42 is coupled with the armature 37 by means of a pin 45 passing through the slot 38 provided in the armature 37. Such construction enables rotation of the contactor 39 together with the shaft 42 and reciprocating motion of said contactor 39 together with the armature 37 when the electromagnet 35 operates.

The device for switching power circuits includes a rotational electromechanical drive 46 providing for rotation of the driving shaft 42 through a predetermined angle the value of which is determined by the location of the contact to be actuated (vacuum chamber on the panel 1). In this modification of the device the drive 46 includes an electric motor 47 provided with a reduction gear whose shaft is coupled, through a half-coupling 48, with a setting device 49 adapted to set the angle of rotation of the driving shaft 42, corresponding to the position of the contact to be operated.

The setting device 49 is made in the form of an arm 50 interacting, through rollers 51 mounted thereon, with a limit switches 52 located in a circle within a frame 53. The number of the rollers 51 is determined by the number of simultaneously operated contacts required to complete a given control circuit. The arm 50 of the setting device is attached to the half-coupling 54 mounted in ball bearings 55 and rigidly coupled with the driving shaft 42. The setting device is secured on an upper metal panel 56 and is coupled with the driving shaft 42 with the aid of a key 57. The panels 1, 11, 44, and 56 are connected with each other with the aid of three pins 58 located symmetrically in a circle about the centre thereof. The device is further provided with a cylinder having a thread and being adapted for securing the device within a housing of an electrical apparatus and providing for the connection of the pin jacks 8 and 10 with the contact pins of the counter panel (not shown). Mating the pin jacks with the contact pins is accomplished with the aid of guide pins 60.

The device is provided with a connector assembly 61 for connecting it with control circuits.

Figure 4:
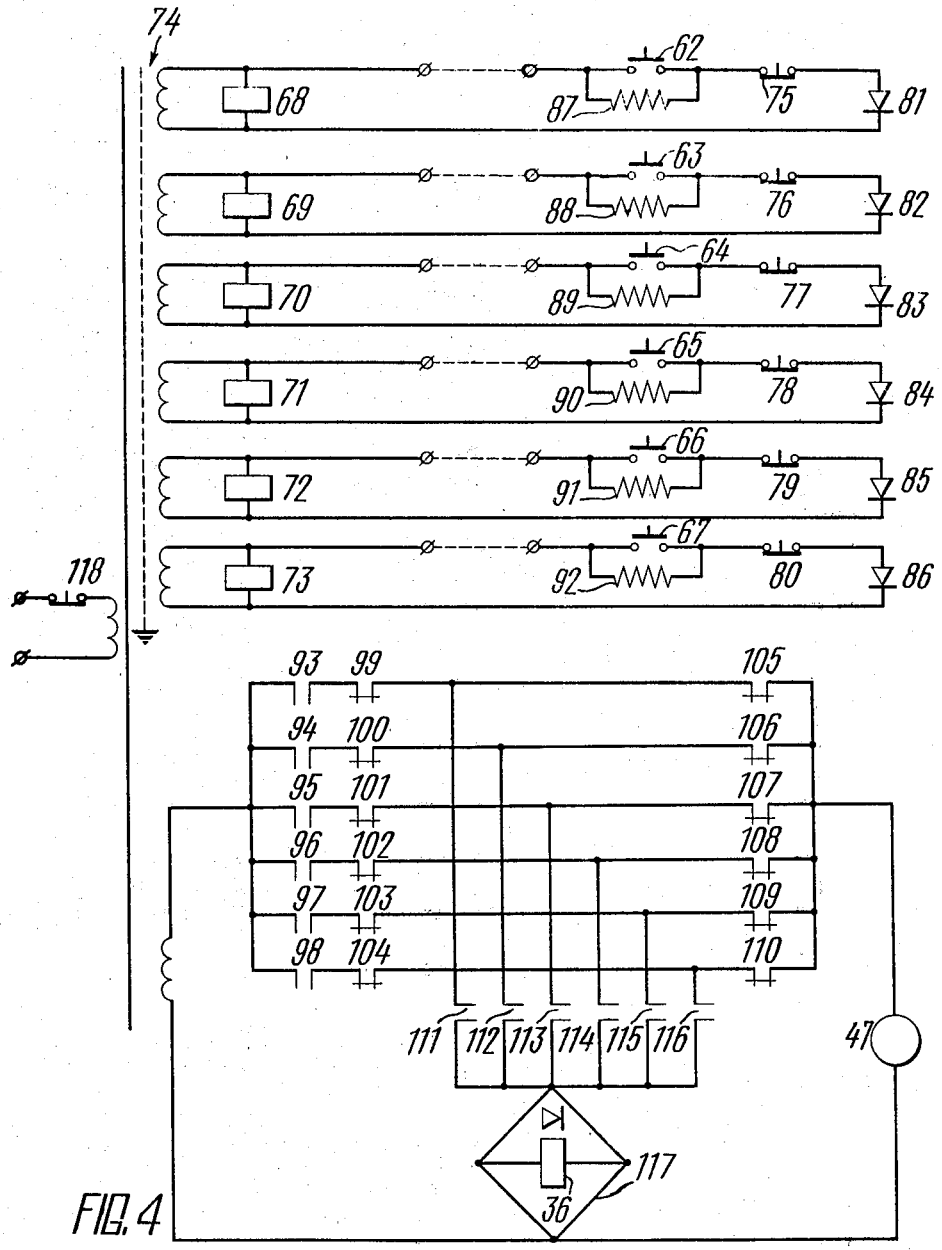
FIG. 4 represents a control circuit of power supply circuits with the use of the proposed apparatus.

FIG. 4 illustrates, as an example of one of the applications of the proposed device, a diagram of exercising control over power circuits with the use of the proposed device. For the sake of simplicity the diagram includes only six circuits.

Shown in FIG. 4 are push buttons "START" 62–67, coils 68–73 of the electromagnets 30 for opening contacts, a transformer 74, push buttons "STOP", 75–80 diodes 81–86, resistors 87–92, supplementary contacts 93–98 of the contact-opening electromagnets, supplementary contacts 99–104 of the microswitches 28 of the switching mechanisms 42, opening contacts 105–110 of the limit switches, making contacts 111–116 of the limit switches, a rectifier bridge 117, and a button "COMMON STOP" 118. Elements of the power supply unit are not shown in the diagram.

In the above control circuit the coils of the electromagnets 30 are connected in parallel with the transformer winding, with the coil parameters being selected so that the current flowing through the coil does not cause the electromagnet to operate. To cause this electromagnet to operate the coil must be shunted by a diode located on the console (81–86).

According to an alternative embodiment of the invention the proposed device for switching power electric circuits comprises a frame 119 (FIG. 5) in the form of a drum formed by an upper and lower discs 120, 121 interconnected therebetween with the aid of rods 122.

Plug-in modules 123 are uniformly arranged in a circle within the frame 119. The movable elements of each said module are connected with a lever 124 directed towards the axis of the frame 119 and having a roller 125 mounted on its end.

In the central portion of the device is located a contact-making solenoid electromagnet 126 comprising a frame 127, a coil 128 and an armature 129 provided with a return spring 130. The frame 127 of the electromagnet is attached together with a flange 131 to the upper disc 120.

Rigidly connected with the armature 129 is a contactor 132 actuating, through the rollers 125, the levers 124 of the modules 123. Depending on the number of modules simultaneously switched into circuit the contactor 132 may have one or more projections 133.

In this modification of the proposed device the contactor 132 has only one projection. A driving shaft 134 of the device is mounted in ball bearings 135, 136 disposed in the flanges 131 and 137 and is passed through the aperture in the frame 127 and the armature 129.

Figure 5:
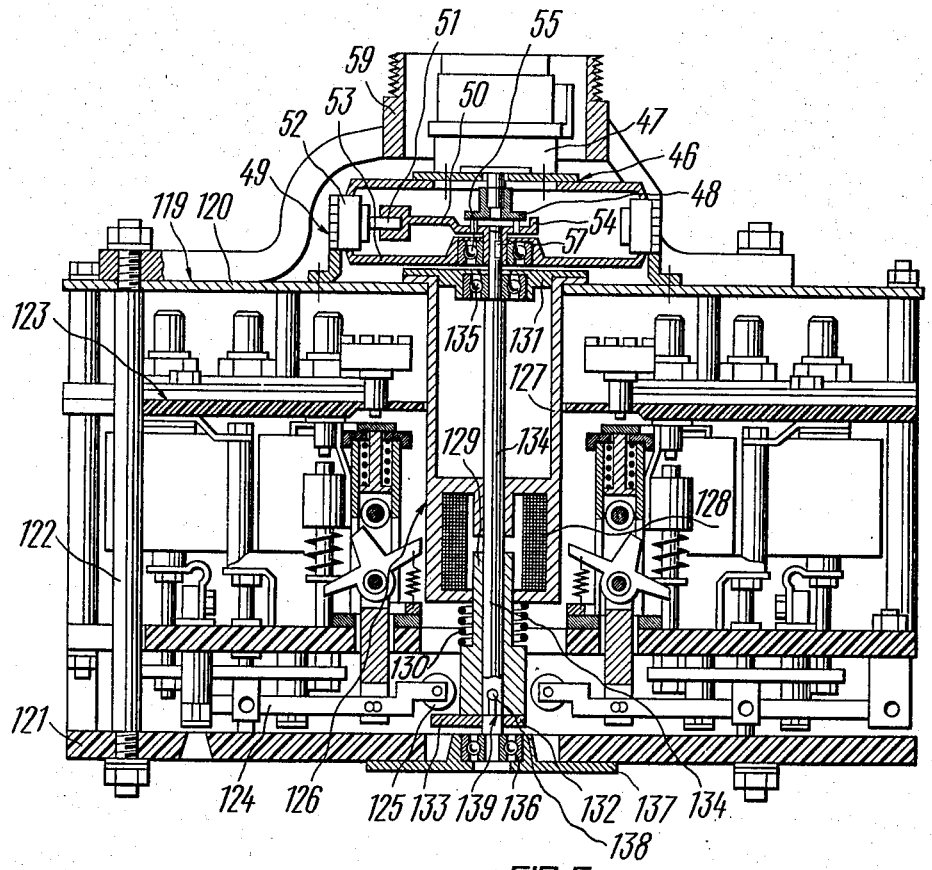
FIG. 5 is a cross-sectional view of a modification of the proposed apparatus.
Figure 6:
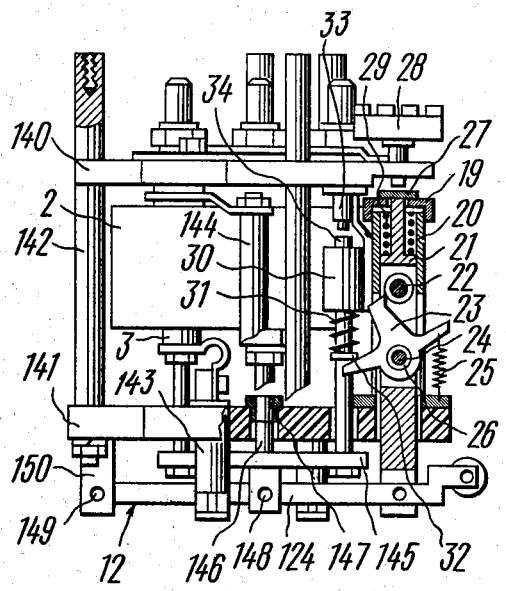
FIG. 6 shows a plug-in module having an electromagnet for opening contacts.

The shaft 134 is coupled with the armature 129 by means of a pin 138 passed through a slot 139 provided in the armature. Each plug-in module 123 (FIG. 6) is made in the form of a frame comprising an upper base plate 140 and a lower base plate 141 connected with each other with the aid of rods 142. On the outer side of and inside the frame are located switching members and driving mechanisms thereof. The drive shown in FIG. 5 is designed for controlling three-phase a.c. circuits and therefore the module includes three main contacts.

As main contacts 2 use is made of arc-extinction chambers. The contacts are fastend on the upper base 140 of the module. Contact terminals of the contacts 2 are made in the form of female connectors 143 and 144. The movable contact members of the contacts 2 are connected therebetween with the aid of an insulating cross-arm 145 which is provided with a roller 146 introduced into a guide bush 147.

Connected with the roller 146 is the lever 124 of a starting drive of the vacuum chambers. This connection is effected through an axle 148. The lever 124 is mounted on a support 150 for rotation about the axis thereof by means of an axle 149.

Figure 7:
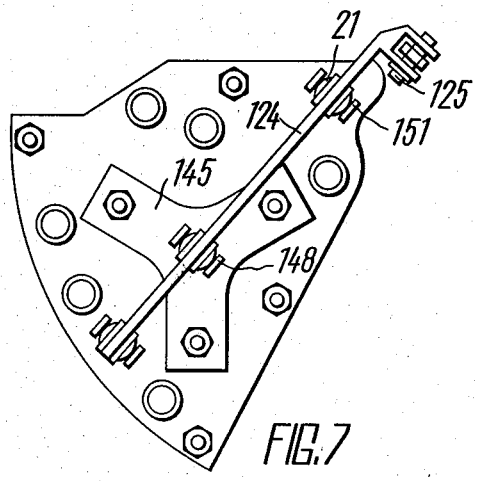

The module is provided with a fixing device 19 whose construction is similar to that shown in FIGS. 1 and 3, and described above. The fixing device 19 is fastened to the lower base plate 141 of the module. The lower end of the rod of the fixing device is pivoted through an axle 151 (FIG. 7) to the lever 124.

The device shown in FIG. 5 is also provided with a rotational electromechanical drive 46 incorporating the electric motor 47 and the setting device 49, the cylinder with the thread 59 and other elements shown in FIGS. 1, 3 as herein described.

The proposed device operates in the follow manner.

By pressing down the push buttons "START" 62–67, for instance 62, the coils 68 (coils 68–73) of the electromagnet 30 is energized with the current flowing through the circuit made up of the transformer 74 secondary, coil 68, push button 62, push button "STOP" 75 (group of the push buttons "STOP" 75–80), diode 81 (group of the diodes 81–86), coil 68, and the secondary of the transformer 74, which causes the electromagnet to operate and to attract its armature, thereby preparing the lock to be raised. Due to the presence of the resistor 87 (resistors 87–92) which shunts the push button 62, the electromagnet 30 remains energized after releasing the push button 62, that is this electromagnet is changed over to a self-holding mode. Instead of the resistors 87–92 use may be made of the blocking contacts of the power circuit, which may also permit operation in a self-holding mode. When the tripping electromagnet operates it actuates the microswitch 33 to thereby close its supplementary contacts 93 (from the second group of the functional contacts 93–98 (whereby the electromotor 47 is energized, with the current flowing through the circuit made up of the secondary of the transformer 74, contacts 93, supplementary opening contact 99 (microswitch 28) from the first group of the functional contacts 99–104, opening contact 105 of the limit switch 52 (from the functional group of the contacts 105–110), electric motor 47, and the secondary of the transformer 74.

The motor starts rotating and rotates the driving shaft 42. When the roller 51 reaches the limit switch 52 corresponding to the operated push button and predetermined contacts, the limit switch is operated so that its contacts 105 open to switch off the electric motor 47, while the closing contacts 111 (from the functional group of the contacts 111–116) of the same limit switch simultaneously connect the coil 36 of the electromagnet 35 in parallel with the secondary winding of the transformer through the bridge rectifier 117.

In this case the electric motor stops, the electromagnet 35 operates and the contactor 39 connected therewith actuates the lever 14 to thereby operate the thus selected contact, in which case at the end of the travel path the supplementary contact 99 (microswitch 28) is opened to deenergize the coil 36 of the electromagnet 35.

From that instant on the device is ready for finding and operating other contacts in a way similar to that described above. Having been operated each contact is fixed in its actual position by the contact fixing device 19. Fixing the contact positions is effected by that the projection 40 of the fixing device presses upon the end of the lever 14 which in turn causes the rod 21 connected thereto to raise and to thereby compress the spring 29 and release the catch 23 which in response rotates about its axis under the action of the spring 25 and locks the rod 21 in its position (FIG. 2).

Opening the required contacts is done by pressing the respective push button "STOP" (75–80), and thereby breaking the supply circuit of the coil (68–73) of one of the electromagnets 30, in which case the latter is deenergized and under the action of its return spring 32 presses with its armature through the rod 31 upon the catch 23 of the fixing device 19, which releases the rod 21. This rod under the action of the spring 29 actuates the lever 14 (FIG. 1) thereby opening the required contact. Simultaneously with the opening of the required contact there opens one of the auxiliary contacts as a result of which the required circuit is prepared for the next possible switching. At the same time one of the auxiliary contacts from the group of the contacts 99–104 (microswitches 28) is closed, thereby also preparing the required circuit for the next switching. After the push button "STOP" is released the electromagnet 30 does not operate again due to the presence in the circuit of a resistor (87–92), that is the control circuit is broken.

In the case of emergency switching-off of all the consumers under control it is necessary to press the push button "COMMON STOP" which will break the supply circuit of all the coils of the breaking electromagnets thereby opening all the main contacts and de-energizing the circuits of the electric motor 47 and the coil 36 of the electromagnet 35.

A zero-voltage protection of all the groups of power contacts is accomplished in a similar way: in the case of voltage collapse or drop all they are opened by the coils 68–73 of the electromagnets 30. It should be noted that the control circuits with the coils 68–73 are non-sparking due to the use of individual high-resistivity secondary windings of the transformer 74, and parallel connection of the coils 68–73 and adequate selection of their resistance and inductance.

These circuits due to the presence of the diodes 81–86 located on the remote control console are capable of self-controlling like a control circuit. In the case of short-circuiting or breakage, or increase in the resistance of the circuit the electromagnets 30 are disconnected and if they are disconnected they cannot be energized by pressing the push buttons 62–67.

The above circuits may also be non-sparking-proof and without control of their completenesss (not shown in FIG. 4). The application of the proposed device is economically efficient. Estimations has shown that operating the proposed device in the explosion-proof control stations makes it possible to considerably reduce a specific amount of metal, labour consumption, size and cost of control stations and similar apparatus. In this case the size and the cost are reduced due to the following favorable factors:

(1) the proposed device occupies by volume approximately 3 times less space as compared with a comparative group of contactors, which also allows the consumption of materials and labour required for the construction of the housing for the apparatus;

(2) there is no need of using control units (with intermediate relay) which are still in use. Each contactor requires only one unit; estimated amount of steel and copper that can be saved constitutes respectively 1 ton and 0.02 to per one control station of the explosion-proof construction.

The application of the proposed device incorporating plug-in modules (FIG. 6) will allow the manufacture of the devices designed for various rated currents and different number of the electric power consumers under control to be simplified.

Considerable economic advantages of the proposed device lies in that it enables easy replacement of individual modules under operating conditions, each of which modules is a complete electrical device provided with power contacts and control elements.

It is also to be noted that the proposed device when in use will contribute in electric energy saving since holding contacts in closed position does not require that the contact closing coils be continuously energized as in the case with contactors. In addition, the device uses only one contact closing coil for a group of circuits under control, which coil is energized during only a rather short period of time.

We claim:

1. A power electric circuit switching device comprising;

a plurality of main contacts composed of stationary contact members arranged in a circle, and movable contact members;

a plurality of first and second auxiliary contacts adapted for switching local control circuits of the device;

mechanisms of separately operating main and auxiliary contacts, which mechanisms being provided with contact fixing devices for fixing said main and first auxiliary contacts;

a rotational electromechanical drive having a driving shaft, adapted to rotate said driving shaft through a predetermined angle;

an electromagnetic drive having an electromagnet for closing said main and first auxiliary contacts, electromagnets for opening said main and auxiliary contacts, and an actuating mechanism;

said actuating mechanism of said electromagnetic drive, comprising an armature of said electromagnet for closing said main and first auxiliary contacts, said armature being formed hollow and mounted on said driving shaft for movement along the axis of said driving shaft and rotation therewith;

plurality of armatures of said electromagnets for opening said main and auxiliary contacts, which armatures reciprocate to open said main and auxiliary contacts, the number of said armatures corresponds to the number of said contact fixing devices of said main and first auxiliary contacts, each of said plurality of said armatures being cnnected with one of said contact fixing devices for opening respective contact;

a contactor secured on said armature of the electromagnet for closing said main and first auxiliary contacts, said contactor being provided with at least one projection to actuate said main and auxiliary contacts.

2. An electric circuit switching device according to claim 1, wherein said second auxiliary contacts are connected with said electromagnets for operating said opening contacts when said electromagnets operate.

3. A device according to claim 1, wherein said electromagnets for opening said main and auxiliary contacts are constructed in the form of zero-voltage releases adapted to operate said contact fixing devices when the coils of these electromagnets are deenergized.

4. A device according to claim 2, wherein said second auxiliary contacts connected with said electromagnets for opening main and auxiliary contacts is placed in the control circuit of said rotational electromechanical drive.

5. A device according to claim 1, wherein said electromagnets for opening said main and auxiliary contacts incorporates coils featuring sparking-proof parameters.

6. A device according to claim 1, wherein said main, and said auxiliary contacts, said mechanisms for separately operating the contacts, and said contact fixing devices are arranged on a plug-in modules mounted on a common base, each module including at least one said main contact, one said auxiliary contact, and respective said mechanism for separately closing contacts, and said contact position fixing device.

7. A device according to claim 6, wherein in the case of three-phase circuits each said plug-in module includes three main contacts, and said contact fixing device is connected, through the mechanism of separately closing contacts, with a cross-arm connecting movable contact members of said main contacts.

* * * * *